US011554416B2

(12) United States Patent
Allroth et al.

(10) Patent No.: US 11,554,416 B2
(45) Date of Patent: Jan. 17, 2023

(54) METHOD FOR PRODUCING A SINTERED COMPONENT AND A SINTERED COMPONENT

(71) Applicant: HÖGANÄS AB (PUBL), Höganäs (SE)

(72) Inventors: Sven Allroth, Strandbaden (SE); Ola Bergman, Helsingborg (SE)

(73) Assignee: HÖGANÄS AB (PUBL), Höganäs (SE)

( * ) Notice: Subject to any disclaimer, the term of this patent is extended or adjusted under 35 U.S.C. 154(b) by 0 days.

(21) Appl. No.: 17/350,286

(22) Filed: Jun. 17, 2021

(65) Prior Publication Data

US 2021/0316363 A1 Oct. 14, 2021

Related U.S. Application Data

(62) Division of application No. 15/105,461, filed as application No. PCT/EP2014/077769 on Dec. 15, 2014, now Pat. No. 11,179,778.

(30) Foreign Application Priority Data

Dec. 20, 2013 (EP) ..... 13198833

(51) Int. Cl.

| | |
|---|---|
| ***B22F 3/23*** | (2006.01) |
| ***C22C 38/00*** | (2006.01) |
| ***C22C 38/04*** | (2006.01) |
| ***C22C 38/34*** | (2006.01) |
| ***C22C 38/40*** | (2006.01) |
| ***C22C 38/60*** | (2006.01) |
| ***C22C 33/02*** | (2006.01) |
| ***B22F 1/00*** | (2022.01) |
| ***B22F 3/16*** | (2006.01) |
| ***B22F 3/24*** | (2006.01) |
| ***B22F 9/04*** | (2006.01) |
| ***B22F 3/10*** | (2006.01) |
| ***B22F 1/10*** | (2022.01) |
| *B22F 3/22* | (2006.01) |

(52) U.S. Cl.

CPC ..... *B22F 3/23* (2013.01); *B22F 1/10* (2022.01); *B22F 3/101* (2013.01); *B22F 3/1017* (2013.01); *B22F 3/16* (2013.01); *B22F 3/24* (2013.01); *B22F 9/04* (2013.01); *C22C 33/0285* (2013.01); *C22C 38/001* (2013.01); *C22C 38/002* (2013.01); *C22C 38/04* (2013.01); *C22C 38/34* (2013.01); *C22C 38/40* (2013.01); *C22C 38/60* (2013.01); *B22F 3/225* (2013.01); *B22F 2003/248* (2013.01); *B22F 2201/013* (2013.01); *B22F 2201/02* (2013.01); *B22F 2201/11* (2013.01); *B22F 2301/35* (2013.01); *B22F 2998/10* (2013.01); *B22F 2999/00* (2013.01); *C21D 2211/001* (2013.01); *C21D 2211/004* (2013.01)

(58) Field of Classification Search

None

See application file for complete search history.

(56) References Cited

U.S. PATENT DOCUMENTS

| | | | |
|---|---|---|---|
| 3,888,657 | A | 6/1975 | Klar et al. |
| 5,856,625 | A | 1/1999 | Saunders et al. |
| 6,168,755 | B1 | 1/2001 | Biancaniello et al. |
| 2003/0095886 | A1 | 5/2003 | Maili et al. |
| 2012/0201712 | A1 | 8/2012 | Oshchepkov |
| 2016/0214177 | A1 | 7/2016 | Ejnermark et al. |

FOREIGN PATENT DOCUMENTS

| | | | |
|---|---|---|---|
| DE | 102009004881 | A1 | 7/2010 |
| EP | 2511031 | A1 | 10/2012 |
| GB | 2016521 | A | 9/1979 |
| JP | H07173506 | A | 7/1995 |
| JP | H09104903 | A | 4/1997 |
| JP | 3527337 | B2 | 2/2004 |
| KR | 1020100075571 | A | 7/2010 |
| KR | 1020120087153 | A | 8/2012 |
| WO | 2009040369 | A1 | 4/2009 |
| WO | 2011045391 | A1 | 4/2011 |

OTHER PUBLICATIONS

Office Action (Notification of Reason for Refusal) dated Nov. 4, 2021, by the Intellectual Property Office in corresponding Korean Patent Application No. 10-2016-7019647, and an English Translation of the Office Action. (3 pages).

International Search Report (PCT/ISA/210) dated Apr. 8, 2015, by the European Patent Office as the International Searching Authority for International Application No. PCT/EP2014/077769.

Written Opinion (PCT/ISA/237) dated Apr. 8, 2015, by the European Patent Office as the International Searching Authority for International Application No. PCT/EP2014/077769.

*Primary Examiner* — Anthony M Liang

(74) *Attorney, Agent, or Firm* — Buchanan Ingersoll & Rooney P.C.

(57) ABSTRACT

A method of making sintered components made from an iron-based powder composition and the sintered component per se. The method is especially suited for producing components which will be subjected to wear at elevated temperatures, consequently the components consists of a heat resistant stainless steel with hard phases including chromium carbo-nitrides. Examples of such components are parts in turbochargers for internal combustion engines.

9 Claims, 3 Drawing Sheets

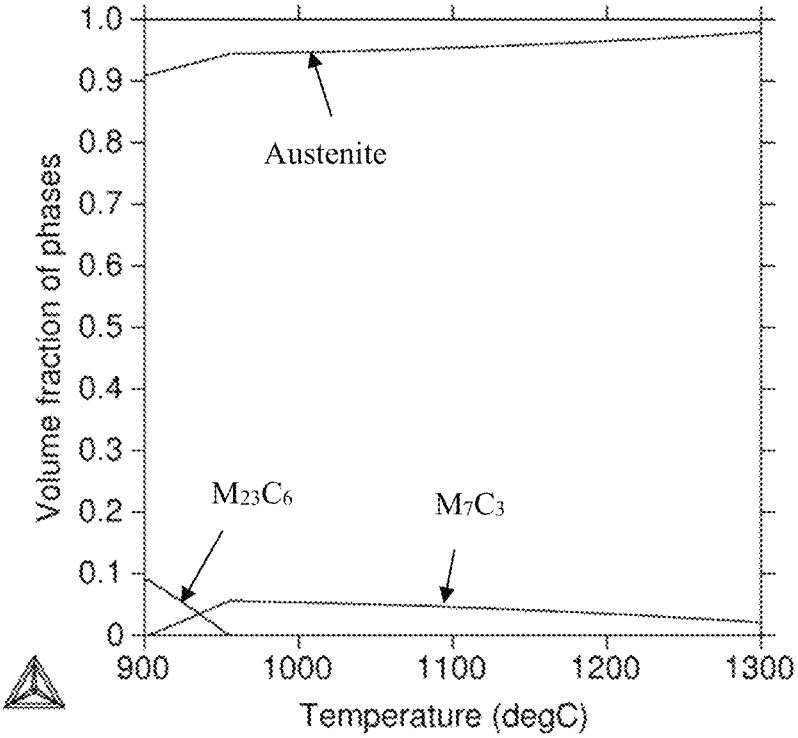
Figure 3
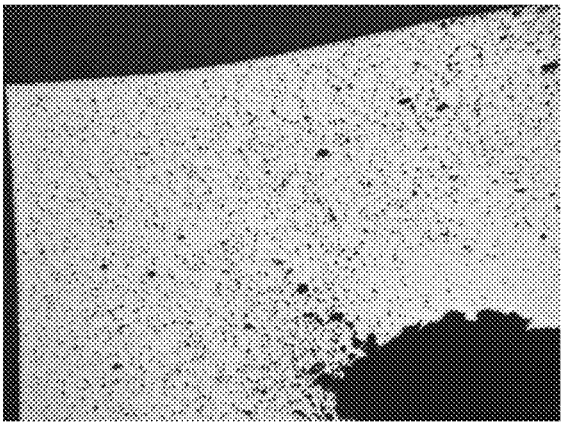
Figure 4. Void inside sintered specimen from trial #1.

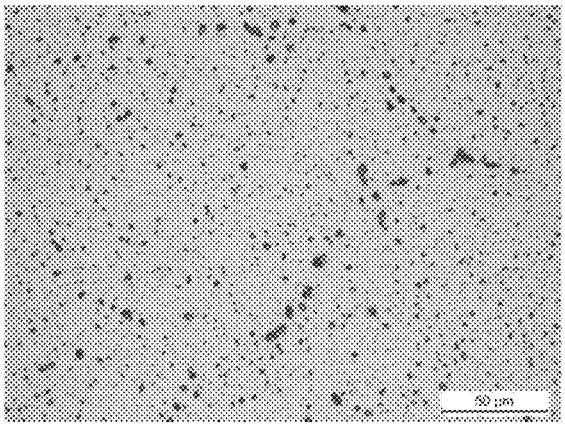
Figure 5. Microstructure of specimen from trial #2.
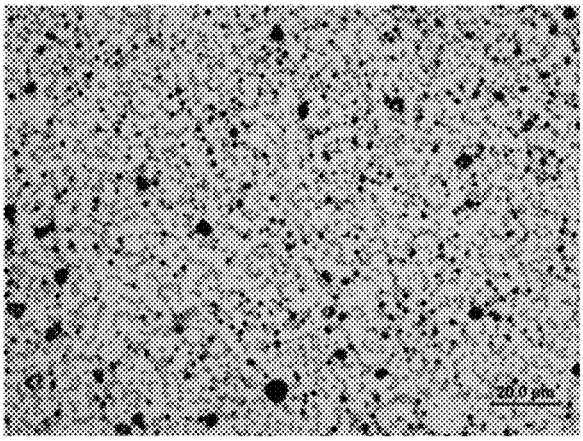
Figure 6. Microstructure in surface region of specimen from trial #3.
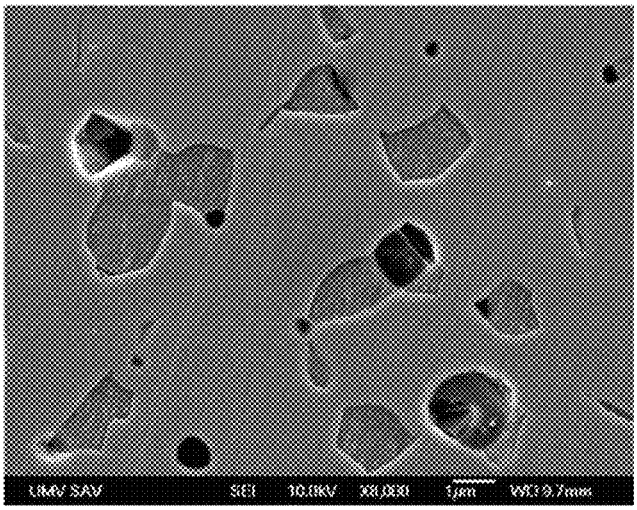
Figure 7

METHOD FOR PRODUCING A SINTERED COMPONENT AND A SINTERED COMPONENT

CROSS REFERENCE TO RELATED APPLICATIONS

The present application is a divisional of U.S. application Ser. No. 15/105,461, filed on Jun. 16, 2016, which is a U.S. national stage of International Application No. PCT/EP2014/077769, filed on Dec. 15, 2014, which claims the benefit of European Application No. 13198833.9, filed on Dec. 20, 2013. The entire contents of each of U.S. application Ser. No. 15/105,461, International Application No. PCT/EP2014/077769, European Application No. 13198833.9 are hereby incorporated herein by reference in their entirety.

TECHNICAL FIELD

The present invention concerns a method of making sintered components made from an iron-based powder composition and the sintered component per se. The method is especially suited for producing components which will be subjected to wear at elevated temperatures, consequently the components consists of a heat resistant stainless steel with hard phases. Examples of such components are parts in turbochargers for internal combustion engines.

BACKGROUND

In industries the use of metal products manufacturing by compaction and sintering of metal powder compositions is becoming increasingly widespread. A number of different products of varying shape and thickness are being produced, and the quality requirements are continuously raised. At the same time it is desired to reduce the costs. Since net shape components, or near net shape components requiring a minimum of machining in order to reach finished shape, are obtained by pressing and sintering of iron powder compositions, which implies a high degree of material utilisation, this technique has a great advantage over conventional techniques such as casting, moulding or machining from bar stock or forgings, for forming metal parts.

However, for some applications a drawback for the press- and sintering method may be that the sintered component contains a certain amount of pores, decreasing the strength of the component. Basically there are two ways to overcome the negative effect on mechanical properties caused by the component porosity:

1) The strength of the sintered component may be increased by introducing alloying elements such as carbon, copper, nickel molybdenum etc.
2) The porosity of the sintered component may be reduced by increasing the compressibility of the powder composition, and/or increasing the compaction pressure for a higher green density, or increasing the shrinkage of the component during sintering.

In practise a combination of strengthening the component by addition of alloying elements and minimising the porosity is applied.

For iron-based sintered components which are subjected to wear and corrosion at elevated temperature a prerequisite in order to withstand such conditions is that the components are made of stainless steel and also containing hard phases. High sintered density, i.e. low porosity is also necessary. Examples of such components are components in turbochargers, such as unison or nozzle rings and sliding nozzles. In these cases closed porosity is desired, which means a sintered density above about 7.3 g/cm$^3$, preferably above 7.4 g/cm$^3$, most preferably above 7.5 g/cm$^3$. The powder metallurgical production route is very suitable for producing such components as they are often produced in large quantities and the components have a suitable size.

Metal Injection Moulding, MIM, is a technique where very fine metal powders are used which typically have a value $X_{50}$ below 10 μm, ($X_{50}$; 50% by weight of the particles have a diameter less than $X_{50}$, 50% by weight have a diameter above $X_{50}$). The powder is mixed with high amounts of organic binders and lubricants in order to form a paste suitable to be injected in a die. The injected component is released from the die and is subsequently subjected to a de-binding process for removing the organic material followed by a sintering process. Small complex shaped components having low porosity can be produced by this method. The patent application DE10 2009 004 881 A1 describes the production of a turbocharger component by this method.

By using finer particle size of the iron-based powder in the composition the green component will shrink more during sintering as such powders have higher specific surface, more active surface, thus yielding a higher sintered density and less porosity.

In the uniaxially pressing technique, coarser iron-based powders are normally used, typically the particle size of the iron-based powder is below 200 μm with about less than 25% below 45 μm. By using finer iron-based powders in the powder composition, components having higher sintered density may be produced. Such compositions, however, normally suffer from poor flowability i.e. the ability of uniformly fill different portions of the die with the powder and with uniform apparent density, AD. The ability of uniformly fill with as small variation as possible of AD of the powder in different portions of the die is essential in order to obtain a sintered component having small variations of the sintered density in different portions. Further, a uniform and consistent filling ensures that the weight and dimensional variations of the pressed and sintered components can be minimized.

The composition must also flow fast enough during the filling stage in order to obtain an economical production speed. Apparent density, flowability and flow rate are commonly referred to as powder properties. Various methods for agglomeration of fine powders to coarser agglomerates having sufficient powder properties and still enhancing shrinkage during sintering have been suggested in order to overcome the above mentioned problems.

JP3527337B2 describes a method for producing agglomerated spray dried powder from fine metal powder or pre alloyed powder.

Components for turbocharger, such as unison or nozzle rings and sliding nozzles, usually contain hard phases in order to withstand wear at elevated temperature. Such hard phases may be carbides or nitrides. Such components may also contain various alloying elements in order to provide enough strength at elevated temperatures above 700° C. The presence of hard phases in combination with alloying elements has however normally a negative influence of compressibility of the iron-based powder composition and of the machinability of the sintered components. In addition, the presence of hard phases in the powder to be consolidated has also a negative influence of the shrinkage, densification, during sintering. The present invention provides a solution to inter alia the above mentioned problems.

BRIEF DESCRIPTION OF THE DRAWINGS

FIG. 3 shows the thermodynamic stable carbides at various temperatures in a 20Cr13Ni0.5C stainless steel material in hydrogen atmosphere ($p_{H2}$=1 atm.).

FIG. 4 shows void inside sintered specimen from trial #1.

FIG. 5 shows the microstructure of specimen from trial #2

FIG. 6 shows the microstructure in surface region of specimen from trial #3.

FIG. 7 shows a Scanning Electron Microscopy (SEM) image of the material shown in FIG. 6, $M_2$(C,N) carbo-nitrides appears as lighter sharp edged particles. Darker particles are MnS.

DETAILED DESCRIPTION

The present invention provides a cost effective method for producing high density heat resistant sintered stainless steel components, containing an effective amount of defined metal-carbo-nitrides without deplete the matrix from chromium and deteriorate the corrosion resistance.

Figure 1:
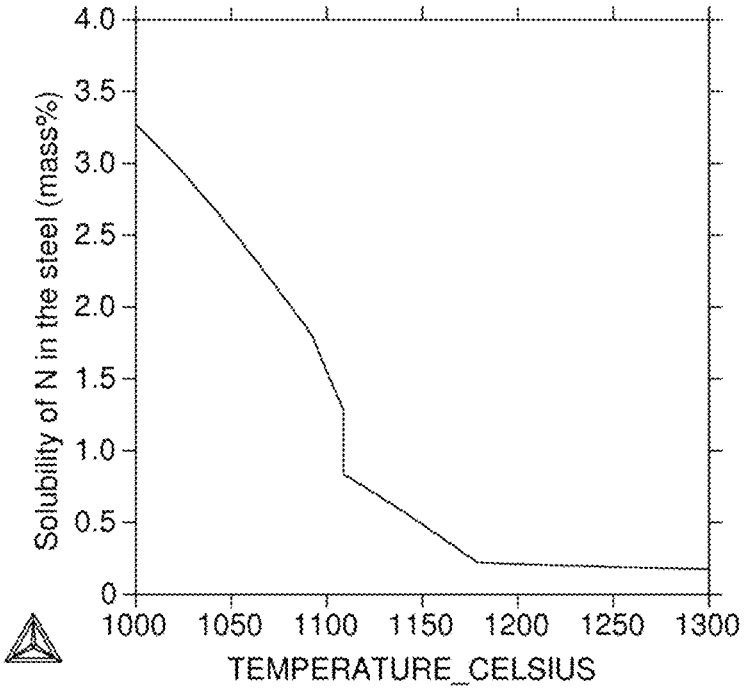
FIG. 1 shows solubility of nitrogen in a 20Cr13Ni0.5C stainless steel powder at various temperatures in nitrogen atmosphere ($p_{N2}$=0.9 atm.).

The invention is based on the finding that the solubility of nitrogen in the applicable stainless steel material is strongly dependent on the temperature and decreases rapidly up to a temperature of about 1180° C. according to FIG. 1. When heating a stainless steel component in a nitrogen containing atmosphere, nitrogen will be dissolved in the structure. When the sintering temperature is reached the solubility is much lower which will lead to nitrogen gas formation and if closed porosity is obtained, i.e. at densities of 7.3 g/cm$^3$ and above, nitrogen gas will be entrapped in the component causing cracks and large pores. The presence of nitrogen gas within the component will also counteract shrinkage and densification.

The inventors have surprisingly found that by a careful control of the sintering atmosphere during the sintering process which comprises heating, sintering and cooling phases, high density, heat and corrosion resistant stainless steel components can cost-effectively be manufactured. Furthermore, the invented process enables the formation of an effective amount of the desired $M_2$(C—N) metal-carbo-nitrides, instead of the less desired M(C—N) metal-carbo-nitrides. Formation of the latter metal-carbo-nitrides in excessive amount may deplete the steel matrix from chromium and thus having an adverse effect on the corrosion resistance.

Water-atomized pre-alloyed powder with fine particle size, i.e. $X_{50}$≤30 μm, preferably $X_{50}$≤20 μm, more preferably $X_{50}$ 10 μm is used to obtain sufficiently high sintering activity for densification during sintering. ($X_{50}$ as defined in ISO 13320-1 1999(E). The chemical composition of the pre-alloyed powder is within the defined composition ranges of the sintered material, except that the nitrogen content is lower (maximum 0.3% by weight of N). The carbon content of the powder can also be lower than the specified lower limit of the sintered material (0.001% by weight of C), in which case graphite is added to the powder before compaction. The fine particle size pre-alloyed powder is preferably granulated into agglomerates in order to get efficient powder flowability in the compaction process. The granulation may be done by a spray drying or freeze drying process. Prior to granulation the powder is mixed with a suitable binder (e.g. 0.5-1% polyvinyl alcohol, PVOH). Mean particle size of the agglomerated powder should be in the range of 50-500 μm.

The granulated powder may be mixed with a suitable lubricant before compaction (e.g. 0.1-1% Amide wax). Other additives can also be admixed to the granulated powder, such as graphite and machinability additives (e.g. MnS).

Compaction is done by conventional uniaxial pressing with 400-800 MPa compaction pressure to reach a density in the range of 5.0-6.5 g/cm$^3$.

Alternatively, the powder may be consolidated into the green component by any other known consolidation processes such as Metal Injection Moulding (MIM), in which case granulation of the stainless steel powder is not needed. In this case the metal powder is in form of a paste.

After consolidation the green component is subjected to the sintering process encompassing heating, sintering and cooling phases.

Heating is performed in an atmosphere of dry hydrogen or in vacuum. The atmosphere shall also have a low oxygen partial pressure to ensure a reducing atmosphere; therefore the dew-point shall be at most −40° C.

When a sufficiently high temperature is reached, i.e. not before 1100° C., the atmosphere is shifted to the sintering atmosphere.

Sintering is done at high temperature, 1150-1350° C. for 15-120 min, in nitrogen containing atmosphere such as pure nitrogen, mixtures of nitrogen and hydrogen, mixtures of nitrogen and inert gases such as argon, or mixtures of nitrogen and hydrogen and inert gas. The content of nitrogen shall be at least 20% by volume. The sintering atmosphere shall also have a low oxygen partial pressure to ensure a reducing atmosphere; therefore the dew-point shall be at most −40° C.

Figure 2:
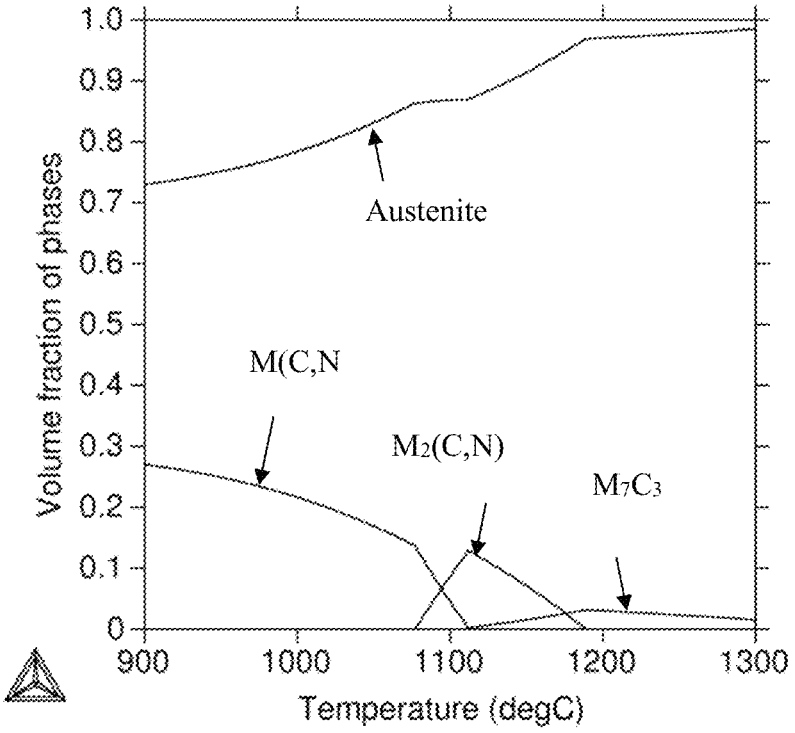
FIG. 2 shows the thermodynamic stable carbo-nitrides at various temperatures in a 20Cr13Ni0.5C stainless steel material in nitrogen atmosphere ($p_{N2}$=0.9 atm.).

Preferable sintering parameters are 1200-1300° C. for 15-45 minutes in nitrogen with up to 10% hydrogen. A small amount of $H_2$ in the sintering atmosphere ensures that surface oxides are sufficiently reduced during sintering for efficient bonding between powder particles. Nitrogen is transferred from the atmosphere to the steel during sintering. Slow cooling (preferably <30° C./min) after sintering must be applied through the temperature range of 1100−1200° C. to allow time for formation of finely dispersed carbonitrides of type M2(C,N) (where M=Cr, Fe) in the material. FIG. 2 shows that such carbo-nitrides will be formed in the austenitic stainless steel in this temperature range in a $N_2$-containing atmosphere. Faster cooling, >30° C./min, should be applied at lower temperatures, <1100° C., to prevent the formation of large amounts of M(C,N) type carbo-nitrides, which would decrease the corrosion resistance of the steel due to sensitization effects. The thermodynamic stability of this carbo-nitrides type M(C,N) at lower temperatures is also demonstrated in FIG. 2.

The sintering atmosphere shall be maintained during the cooling phase at least to a temperature of 1100° C.

Accordingly, the process according to the present invention will contain following steps:

Providing a stainless steel powder having the following composition:

Cr 15-30%
Ni 5-25%
Si 0.5-3.5%
Mn 0-2%
S 0-0.6%
C 0.001-0.8%
N ≤1:1.3%

O ≤1:1.5% optionally up to 3% of each of the elements Mo, Cu, Nb, V, Ti and inevitable impurities up to 1%, Fe balance, optionally agglomerating the stainless steel powder, optionally mixing with lubricants, hard-phase materials, machinability enhancing agents and graphite, optionally transforming the powder into a suitable paste or feedstock, consolidating the obtained paste, feedstock or granulated powder into a green component, heating the obtained green component in vacuum or in an atmosphere of hydrogen gas to a temperature of at least 1100° C.

sintering the green component at a temperature between 1150-1350° C. in an atmosphere of at least 20% nitrogen gas.

cooling the sintered component at a cooling rate of at most 30 C/min from the sintering temperature to a temperature of ≥100° C. in an atmosphere of at least 20% nitrogen gas to form sufficient amount of M2(C, N) carbo-nitrides, cooling the sintered component from 1100° C. to ambient temperature at a cooling rate of at least 30 C/min and sufficiently high enough to avoid excessive formation of M(C,N) carbo nitrides yielding a component having at least 12% by weight of Cr in the matrix.

In another embodiment of the method according to the present invention the stainless steel powder has the following composition:

Cr 17-25%
Ni 5-20%
Si 0.5-2.5%
Mn 0-1.5%
S 0-0.6%
C 0.001-0.8%
N ≤0.3%
O ≤0.5%
optionally up to 3% of each of the elements Mo, Cu, Nb, V, Ti and inevitable impurities up to 1% Fe balance.

In an alternative embodiment of the present invention the stainless steel powder has the following composition:

Cr 19-21%
Ni 12-14%
Si 1.5-2.5%
Mn 0.7-1.1%
S 0.2-0.4%
C 0.4-0.6%
N ≤1.3%
O ≤1.5%
optionally up to 3% of each of the elements Mo, Cu, Nb, V, Ti and inevitable impurities up to 1% Fe balance.

In another embodiment of the method according to the present invention consolidation is performed by uniaxial compaction at a compaction pressure of about 400-800 MPa to a green density of about 5.0-6.5 g/cm$^3$.

In still another embodiment of the present invention consolidation is performed by Metal Injection Molding (MIM).

The sintered material according to the present invention is distinguished by having sintered density of at least 7.3 g/cm$^3$, preferably at least 7.4 g/cm$^3$ and most preferably at least 7.5 g/cm$^3$. The chemical composition of the sintered material is according to below:

Cr 15-30%
Ni 5-25%
Si 0.5-3.5%
Mn 0-2%
S 0-0.6%
C 0.1-0.8%
N 0.1-1.5%
O <0.3%
optionally up to 3% of each of the elements Mo, Cu, Nb, V, Ti and inevitable impurities up to 1%,
Fe balance.

In another embodiment of the sintered material according to the present invention has a chemical composition according to below:

Cr 17-25%
Ni 5-20%
Si 0.5-2.5%
Mn 0-1.5%
S 0-0.6%
C 0.1-0.8%
N 0.1-1.0%
O <0.3%
optionally up to 3% of each of the elements Mo, Cu, Nb, V, Ti and inevitable impurities up to 1%
Fe balance.

In an alternative embodiment of the present invention the sintered material has a chemical composition according to below:

Cr 19-21%
Ni 12-14%
Si 1.5-2.5%
Mn 0.7-1.1%
S 0.2-0.4%
C 0.4-0.6%
N 0.1-1.0%
O <0.3%
optionally up to 3% of each of the elements Mo, Cu, Nb, V, Ti and inevitable impurities up to 1%
Fe balance.

The sintered material has an austenitic microstructure which is strengthened in the surface region, the region from the surface to a depth of between about 20 μm to about 500 μm perpendicular from the surface, by about 5-15 vol %, of finely dispersed $M_2$(C,N) type carbo-nitrides, as shown by the thermodynamic equilibrium phase composition of the material at a temperature just above 1100° C., as illustrated in FIG. 2.

The size of the carbo-nitrides is below 20 μm, preferably below 10 μm and most preferably below 5 μm. A preferred size of the carbo-nitrides is 1-3 μm. The carbo-nitrides are evenly distributed throughout the austenitic matrix with a typical distance between adjacent precipitates of 1-5 μm.

The austenitic matrix contains at least 12% by weight of chromium, needed for corrosion resistance, and the austenite grains are very fine typically below 20 μm, preferably below 10 μm, finer grain size is beneficial for the mechanical strength and oxidation resistance of the material.

Besides the precipitated hard metal-carbide-nitride phases the sintered material may also contain fine manganese sulfide (MnS) phases, such phases is preferably below 10 μm in order to obtain sufficient machinability properties.

The sizes of the carbo-nitrides and MnS phase is determined by measuring its longest extension through light optical microscopy. The size of the austenite grains being determined according to ASTM E112-96.

The characteristics of this microstructure provide excellent high temperature properties to the sintered material, such as resistance to corrosion, oxidation and wear. Suitable application is turbocharger and other components subjected to hot gases in combustion engines for operating temperatures of up to 1000-1100° C.

EXAMPLES

Water-atomized stainless steel powder A according to table 1 with fine particle size, median particle diameter according to SS-15013320-1, $X_{50}$<10 μm, was used as test material. The powder was mixed with a binder solution and granulated using spray drying technique into larger particles with mean particle size of around 180 μm. The granulated powder was mixed with lubricant (0.5% Amide wax) and pressed by uniaxial compaction with 600 MPa compaction pressure into cylindrical test specimens (ϕ=25 mm, h=15 mm). Green density of the compacted specimens was 5.90 g/cm$^3$.

Three sintering trials were performed and different protective gas atmospheres were used in each trial according to table 2. The pressure during sintering was one atmosphere. Heating rate up to sintering temperature (T) was about 5° C./min and cooling rate after sintering was 10° C./min from T to 1100° C. and 50° C./min from 1100° C. to room temperature in all three trials.

TABLE 1

Chemical composition (in weight-%) of powder A.

| Fe | Cr | Ni | Si | Mn | S | C |
|---|---|---|---|---|---|---|
| Base | 19 | 13 | 2.1 | 0.9 | 0.3 | 0.5 |

TABLE 2

Sintering trial parameters.

| Trial # | T [° C.] | Time at T [min] | Atmosphere |
|---|---|---|---|
| 1 | 1250 | 30 | N2/H2 (90/10) |
| 2 | 1250 | 30 | H2 |
| 3 | 1250 | 30 | Part 1*:H2<br>Part 2**:N2/H2 (95/5) |

*Heating stage (until T was reached)
**Isothermal + cooling stage

Examination of sintered specimens from trial #1 showed excessive swelling and crack formation due to large void formation inside the specimens during sintering, as illustrated in FIG. 4 which is a picture from Light Optical Microscopy (LOM). This void formation is caused by $N_2$ gas formation at high temperature. Specimens from the other two sintering trials (#2 and #3) were sintered to high density (7.50-7.52 g/cm3, corresponding to >96% of theoretical density) and had no signs of cracks.

The microstructure (LOM) of the material that were sintered in pure H2 (trial #2) consists of small Cr-carbide precipitates in an austenitic matrix (see FIG. 5) throughout the specimens. Similar microstructure (LOM) is found in the centre of the specimens from trial #3. However, in the specimen surface regions (up to~300 μm from the surface) after sintering trial #3, there are many Cr-carbo-nitride precipitates evenly distributed in the austenitic matrix (see FIG. 6). These carbo-nitride precipitates gave significantly higher specimen surface hardness after trial #3 (HV10=252) compared to the specimen surface hardness after trial #2 (HV10=179). The surface hardness HV10, was measured according to SS-EN-ISO 6507.

The invention claimed is:

1. A sintered component containing:
Cr 15-30 wt %
Ni 5-25 wt %
Si 0.5-3.5 wt %
Mn 0-2 wt %
S 0-0.6 wt %
C 0.1-0.8 wt %
N 0.1-1.5 wt
O 0.3 wt
optionally up to 3 wt % of each of the elements Mo, Cu, Nb, V, Ti and inevitable impurities up to 1 wt %,
Fe balance, and
an austenitic microstructure which is strengthened in a surface region from a surface to a depth of 20-500 μm perpendicular from the surface, by about 5-15 vol % of finely dispersed $M_2$(C,N) type carbo-nitrides.

2. The sintered component of claim 1, wherein the size of the carbo-nitrides is below 20 μm and evenly distributed throughout the austenitic matrix.

3. The sintered component of claim 1, wherein the size of the carbo-nitrides is below 5 μm and evenly distributed throughout the austenitic matrix.

4. The sintered component of claim 1, wherein the size of the carbo-nitrides is between 1-3 μm with a typical distance between adjacent carbo-nitrides of 1-5 μm.

5. The sintered component of claim 1, wherein the austenite grains are fine having a grain size below 20 μm.

6. The sintered component of claim 1, wherein the austenite grains are fine having a grain size below 10 μm.

7. The sintered component of claim 1, having a sintered density of at least 7.3 g/cm$^3$.

8. The sintered component of claim 1, having a sintered density of at least 7.5 g/cm$^3$.

9. The sintered component of claim 1, wherein the size of the carbo-nitrides is between 1-3 μm.

* * * * *